United States Patent [19]

Schwerdtel et al.

[11] Patent Number: 4,566,249

[45] Date of Patent: Jan. 28, 1986

[54] APPARATUS FOR THE DOSED FILLING OF HIGHLY VISCOUS MATERIAL

[76] Inventors: Ernst Schwerdtel, Am Blütenanger 24, D-8000 München 50; Hans-Jörg Lang, Haus No. 61, D-8061 Biberbach, both of Fed. Rep. of Germany

[21] Appl. No.: 589,957

[22] Filed: Mar. 15, 1984

[51] Int. Cl.[4] ..... B65B 3/02; B65B 3/32; B65B 9/20; B65B 59/02

[52] U.S. Cl. ..... 53/55; 53/511; 53/513; 53/516; 53/552

[58] Field of Search ..... 53/55, 66, 502, 552, 53/551, 511, 513, 516, 389

[56] References Cited

U.S. PATENT DOCUMENTS

| | | | |
|---|---|---|---|
| 3,282,020 | 11/1966 | Smith | 53/551 |
| 3,522,631 | 8/1970 | Niclas | 53/513 X |
| 3,579,945 | 5/1971 | Buchner et al. | 53/511 |
| 3,831,821 | 8/1974 | Doyen | 53/552 X |
| 4,023,327 | 5/1977 | Simmons | 53/552 X |
| 4,241,563 | 12/1980 | Müller et al. | 53/511 |

*Primary Examiner*—Horace M. Culver

[57] ABSTRACT

An apparatus for the dosed filling of highly viscous material, particularly pasty sealing compound, into tubular bags has a dosing device and a filling device connected thereto, which is provided with a filling tube projecting into the foil tube. The apparatus also has a closing device for the filled tubular bags. In order to permit a dosed filling of highly viscous, stringy materials into tubular bags, the filling device has a foil tube formation device surrounding the filling tube. There is also a conveying mechanism for the foil tube and a pick-up for determining the dosed material quantity and a pick-up for determining the conveying length of the foil tube. A device for cutting through the material strand is positioned directly at the end of the filling tube. There is also a transverse welding means with a cutting device below the filling device.

6 Claims, 6 Drawing Figures

APPARATUS FOR THE DOSED FILLING OF HIGHLY VISCOUS MATERIAL

BACKGROUND OF THE INVENTION

This invention relates to an apparatus for the dosed filling of highly viscous material, particularly stringy material, such as pasty, permanent elastic sealing compounds, into tubular bags.

Hitherto highly viscous materials, such as in particular pasty, stringy sealing compounds, have generally been filled into cartridges. Although no technical problems are encountered in the dosed filling of cartridges, the disadvantage arises that these disposable cartridges are relatively expensive. An essential aspect in connection with filling, particularly under the influence of sealing compounds which harden or vulcanize under the influence of atmospheric humidity is that the pack must not contain any humidity and there must also be no contact with atmospheric humidity. Particularly permanent elastic sealing compounds already contain the hardener and become solid under the influence of atmospheric humidity.

Hitherto the filling of such highly viscous materials into tubular plastic bags has either taken place manually, which is very costly, or machines from the meat processing industry are used, in which the finished, filled bag is sealed by means of an aluminium wire clip. However, it is not possible to obtain a completely tight seal. Up to now the problem of packing materials which become solid under the influence of moisture in tubular bags was that it was necessary to use plastic foils with an aluminium coating as a vapour lock, in order to achieve adequate storage characteristics for the packed sealing compound. However, it has not as yet been possible to obtain a completely satisfactory filling and bubble-free sealing of tubular bags by means of an airtight transverse weld without visual inspection.

SUMMARY OF THE INVENTION

The object of the invention is therefore to provide an apparatus of the type defined hereinbefore, which permits the dosed filling of such highly viscous materials into tubular bags.

According to the invention, such an apparatus comprises a dosing device for the material and a pick-up for determining the dosed material quantity associated with said dosing device; a material filling device connected to the dosing device and having a filling tube and a foil tube formation device surrounding the filling tube and provided with a conveying mechanism for the formed foil tube, a pick-up for determining the conveying length of the foil tube being provided as well as a device for cutting through the material at the end of the filling tube; and a transverse welding means with a cutting device positioned below the filling device.

In the apparatus according to the invention, the material is supplied in dosed manner through a filling tube, which is surrounded by a foil tube formation device, in which a foil tube is continuously formed. The foil tube is conveyed in accordance with the material quantity supplied in dosed manner, pick-ups ensuring that the foil tube conveying length always precisely corresponds to the material quantity supplied in dosed manner and filled. This simultaneously ensures that in the lower transverse welding means, the foil tube is welded directly above the level of the filling, so that the finished tubular bag cannot contain bubbles. It is simultaneously ensured that no material enters the transverse weld, which would reduce the strength thereof or could even provide a direct link with the external air. Optical inspection of the filling and sealing process is no longer necessary. The foil tube is filled from its bottom, the lower end being sealed by a transverse weld. The material strand is cut off without drips.

Preferably, the pick-up for determining the dosed material quantity is constructed as a rotary pick-up, which is directly coupled to the dosing device. This ensures that in a constructionally very simple manner the material quantity conveyed by the dosing mechanism is accurately defined, so that there is an actual value with respect to said quantity, which on the one hand can be used for ending the dosing—conveying process and on the other hand can be used as a desired value for the conveying of the foil tube.

The pick-up for determining the conveying path of the foil tube is desirably constructed as a rotary pick-up directly driven by the foil tube. This ensures that the actual conveying path of the foil tube is accurately defined, so that this value can once again be used as an actual value in the control of the foil tube conveying mechanism.

In a preferred embodiment, a rotary tube is arranged between the filling tube and the foil tube formation device surrounding the latter, said rotary tube having at its lower end at least one cutting wire positioned directly in front of the filling tube. This ensures that, in a very simple manner, there is a drip-free cutting off of the material strand passing out of the filling tube, without thereby influencing or impairing dosing.

A valve may be provided approximately flush with the cutting wire at the end of the filling tube in order to ensure an accurate dosing even in the case of fluid materials.

The measures according to the invention make it possible to use the hitherto employed means for supplying an inert gas into the area where the material passes out of the filling tube, so that there is always a dry inert gas atmosphere in the foil tube.

The conveying mechanism desirably has two diametrically opposite, synchronously drivable, endless conveyor belts, which are adapted to engage with the foil tube supplied externally by means of a format tube of the foil tube formation device. This gives a particularly simple and effective conveying mechanism for a slip-free, clearly defined conveying of the foil tube.

Preferably, the transverse welding means has closable welding jaws, on which are resiliently mounted gripping members which are adapted to pinch off the foil tube in advance of the closing movement. This ensures that the foil tube is initially closed in the immediate vicinity of the fill level and only then is welded.

BRIEF DESCRIPTION OF THE DRAWINGS

The invention will now be further described by way of example, with reference to the drawings, in which.

DESCRIPTION OF PREFERRED EMBODIMENT

Figure 1:
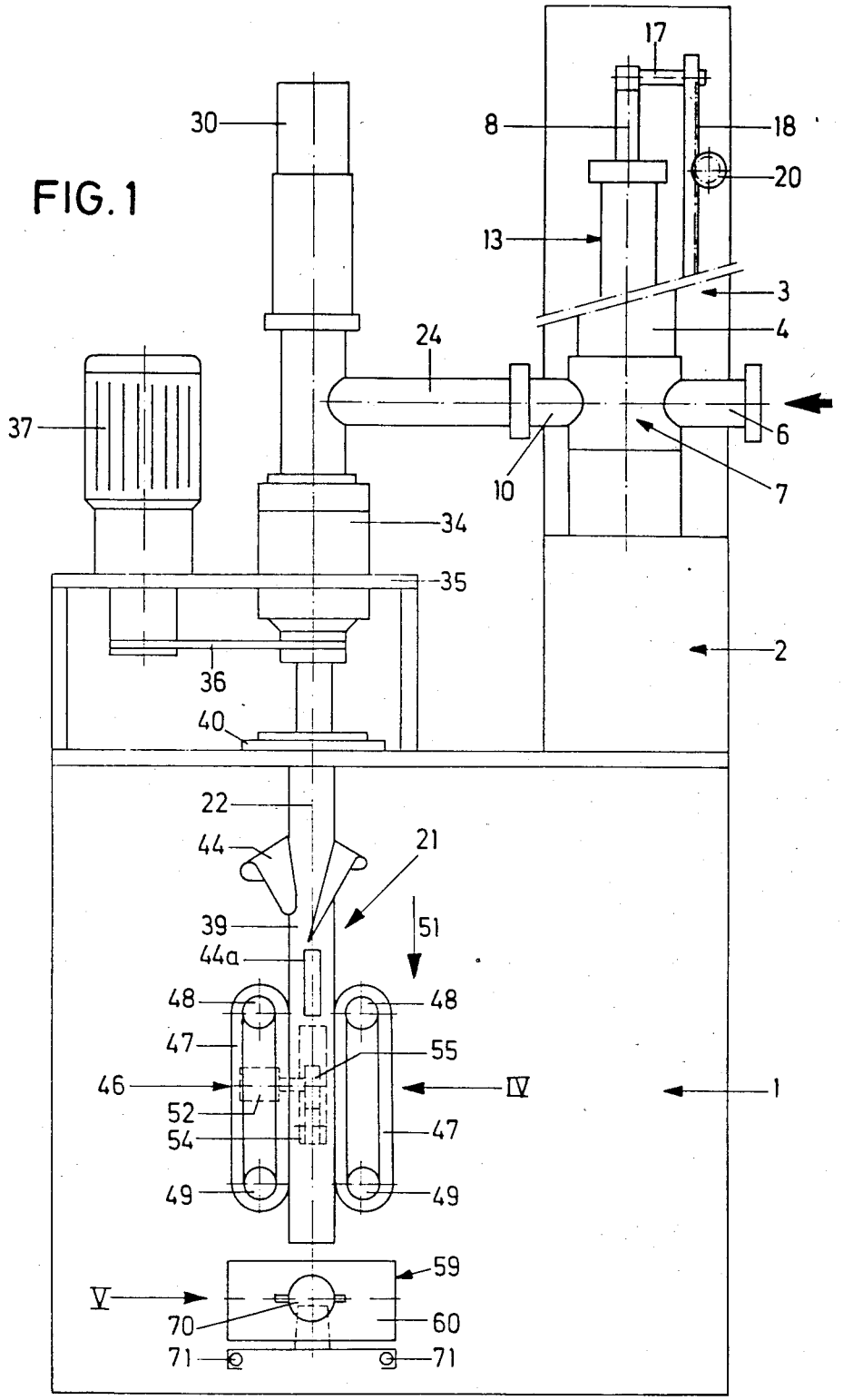
FIG. 1 is a vertical view of one embodiment of an apparatus according to the invention.
Figure 2:
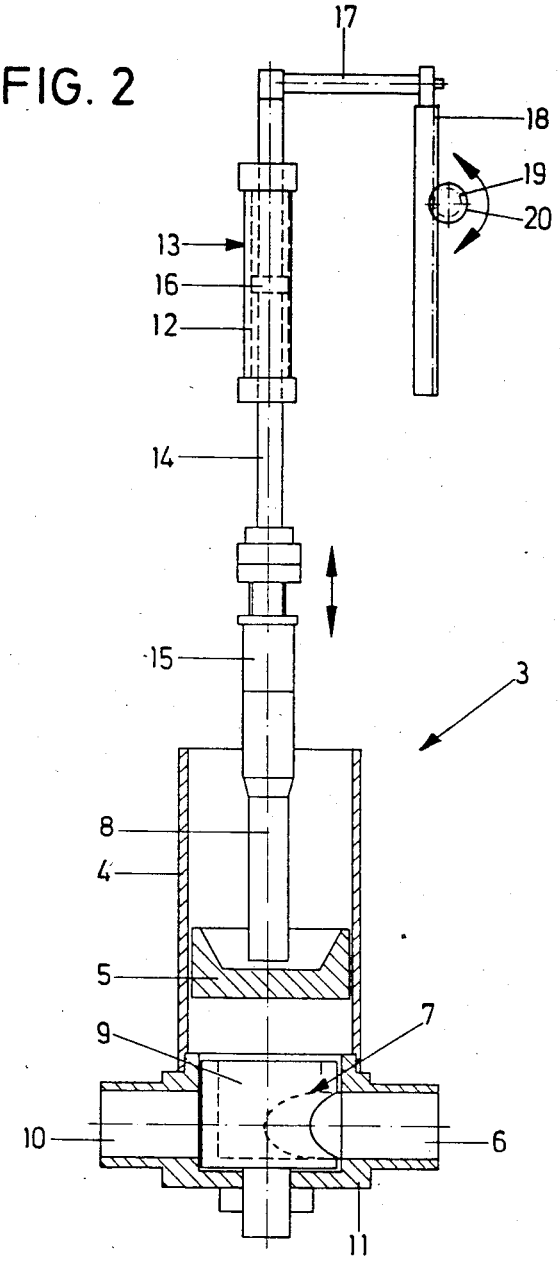
FIG. 2 shows the dosing device of the apparatus shown in FIG. 1 in part sectional form.
Figure 3:
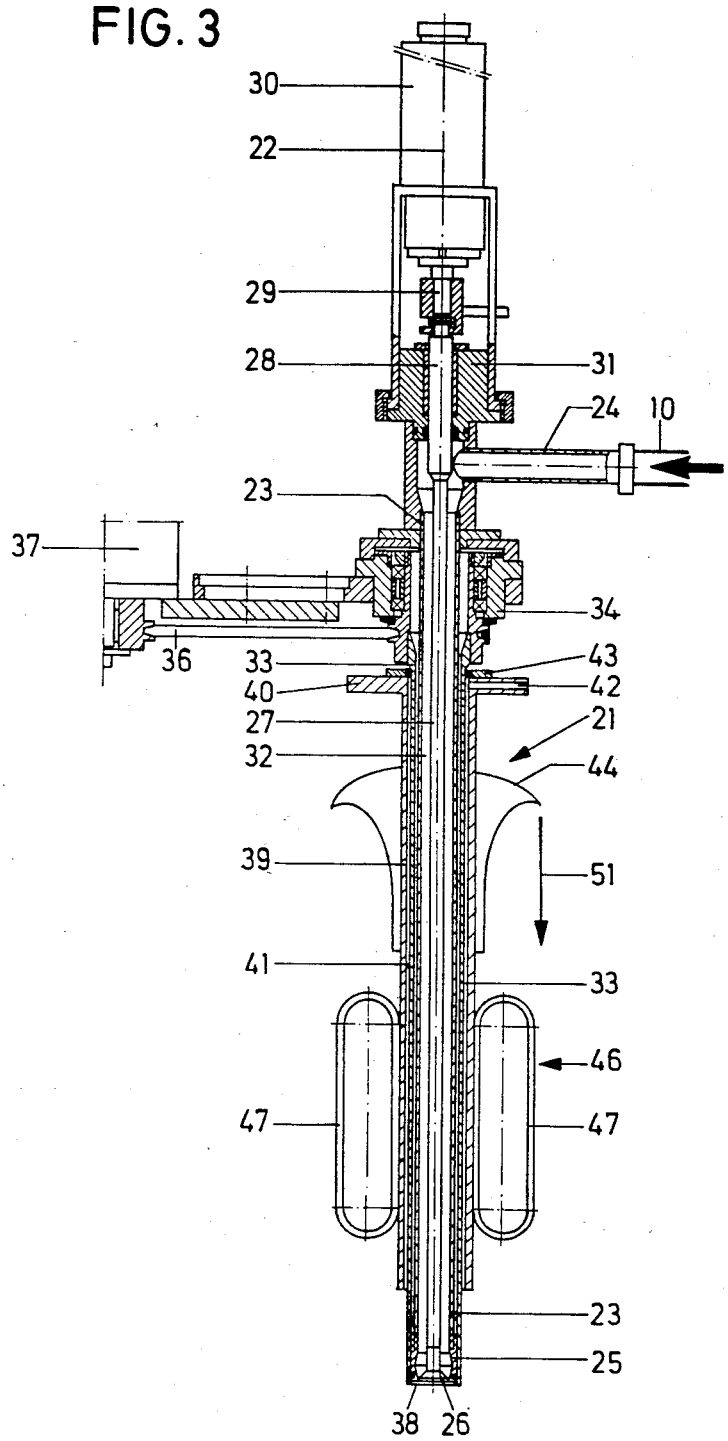
FIG. 3 shows the filling device of the apparatus shown in FIG. 1 in a substantially sectional form.
Figure 4:
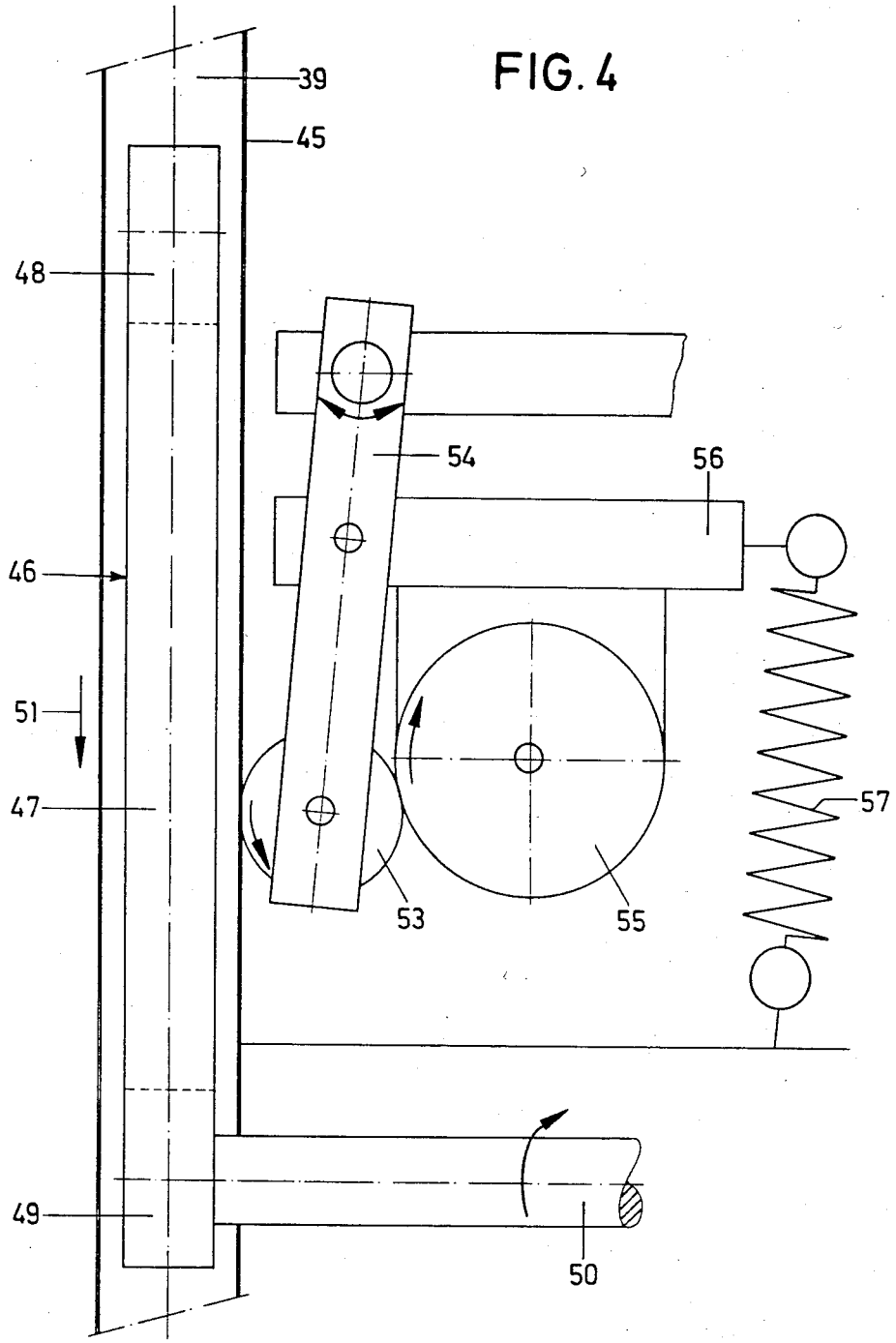
FIG. 4 is a partial view taken along arrow IV of FIG. 1.

The apparatus shown in FIG. 1 has a machine frame 1, which has a turret-like structure 2 carrying a dosing device 3, which is shown in detail in FIG. 2. The dosing device 3 has a dosing cylinder 4, in which a dosing piston 5 is mounted in a floating manner. A supply line 6, through which the material to be dosed is supplied by means of a pump (not shown), issues into the lower area of the dosing cylinder 4. A cone plug 7 is arranged at the bottom of the dosing cylinder and can be rotated by 180° about its axis, which coincides with the median longitudinal axis 8 of the dosing cylinder 4. As a result its flow passage 9 can either connect the supply line 6 to the inner area of the dosing cylinder 4 or the latter to a discharge line 10, which is aligned with the supply line 6. The supply line 6 and discharge line 10 are directly fitted to the casing 11 of the cone plug 7.

A cylinder 12 of a hydraulic piston-cylinder drive 13 is positioned above the dosing cylinder 4 so as to be aligned with its axis 8. A piston rod 14 of drive 13 is provided with a length-adjustable feed rod 15, which engages with the top of a dosing piston 5 but is not connected thereto. A piston 16 of drive 13 is also coupled to a transmission rod 17, which passes upwards out of the cylinder 12, said rod 17 being connected to a rack 18 arranged parallel to the axis 8. The rack 18 engages in a pinion 19 of a rotary pick-up 20. On the basis of the represented coupling, said rotary pick-up 20 emits a signal, which represents the exact position of the piston 16 with piston rod 14 and consequently dosing piston 5, when the latter engages on the feed rod 15.

The machine frame 1 also carries a filling device 21, whose median longitudinal axis 22 is arranged vertically in the same way as axis 8. Concentric to the axis 22, the filling device 21 has a filling tube 23 connected by means of a supply connection 24 with the discharge line 10 of the dosing device 3, so that precisely the material quantity dispensed in dosed manner by the dosing device 3 passes into the filling tube 23.

At its lower end, the filling tube 23 has a nozzle 25, which can be sealed by means of a valve 26, whose tappet 27 is connected to a stem 28, which is in turn connected to the piston rod 29 of a servodrive 30 for valve 26 connected in the manner of a pneumatic piston-cylinder drive. The stem 28 is mounted in sealed manner in a casing 31, being displaceable axially parallel to itself. The supply connection 24 enters and the elongated filling tube 23 leaves the casing 31. As can be gathered from the drawing, the complete arrangement is positioned concentrically to the axis 22. The material to be conveyed is passed through the annular space 32 between the tappet 27 and filling tube 23. The valve 26 is opened, when the piston rod 29 and consequently the stem 28 and tappet 27 are moved upwards, so that the valve 26 is drawn into the nozzle 25.

A rotary tube 33, rotatable about the axis 22 is arranged concentrically around the filling tube 23. The upper end of this rotary tube is mounted in rotary manner in a bearing housing 34, which is supported in a support 35 of the machine frame 1. In its upper area directly below the bearing housing 34, the rotary tube 33 is driven by an electric drive motor 37, constructed as a clutch brake motor via a V-belt drive 36. This drive motor 37 is also mounted on the support 35.

On the lower end of the rotary tube 33 is positioned a cutting wire 38, which runs diametrically over its front face. The cutting wire 38 is also positioned directly below, i.e. in front of the valve 26 and in the case of a corresponding rotary drive of the rotary tube 33 cuts through the strand of pasty material left at the end of a filling process. Thus, a material cutting device is formed by the rotary tube 33 with the cutting wire 38.

A format tube 39, which is fixed to the machine frame 1 by means of an upper retaining flange 40, is arranged concentrically around the rotary tube 33. An annular clearance between the format tube 39 and the rotary tube 33 serves as a channel 41 for an inert gas, which is supplied to said channel by means of a connection 42. The connection 42 is formed at the upper end of the channel 41 in the retaining flange 40. Immediately above the same, the channel 41 is upwardly sealed by means of a sealing flange 43.

Just below the retaining flange 40 of the format tube 39 is provided a format shoulder 44 which surrounds the format tube 39 and by means of which, in generally known manner, a foil web is shaped into a foil tube 45 embracing the format tube 39. This foil tube 45 is longitudinally welded by a conventional welding means 44*a*, which is only intimated in the drawing.

The foil tube is conveyed downwards by means of a conveying mechanism 46, which has two endless conveyor belts 47, arranged diametrically to one another on the format tube 39. The belts 47 are guided by means of pulleys 48, 49, the lower pulleys 49 being drivable by a shaft 50 by a drive motor (not shown), so that driving takes place in the conveying direction indicated by the arrow 51.

A rotary pick-up 52, which detects the conveying of the foil tube 45 in the conveying direction 51, is also associated with the conveying mechanism 46. For this purpose, a driving gear 53 engages on the foil tube 45, which is mounted in a rocking lever 54. Under frictional grip, a pinion 55 for the rotary pick-up 52 engages with the driving gear 53 and is once again mounted in a rocking lever 56, connected to the rocking lever 54. The rocking lever 56 is tensioned by a spring 57, which can be biased, so that the pinion 55 can be pressed with a presettable force against the driving gear 53, whilst the latter can be pressed with a presettable frictional force against the foil tube 45. Thus, the rotary pick-up 52 determines the actual conveying of the tube 45 in a quantitatively accurate manner, without slip between the driving gear 53 and foil tube 45 and without slip between the driving gear 53 and pinion 55. The driving gear 53 and pinion 55 may appropriately have bearing surfaces of rubber or the like.

The format tube 39 ends just above the valve 26 or the cutting device.

Below the valve 26 is provided a welding means 59 on the machine frame 1, which is also aligned with the axis 22. The welding means 59 has two oppositely movable welding jaws 60, 61, by means of which the foil tube can be transversely welded and cut directly below filling 62, so that the filled tubular bag 63 is formed.

Figure 6:
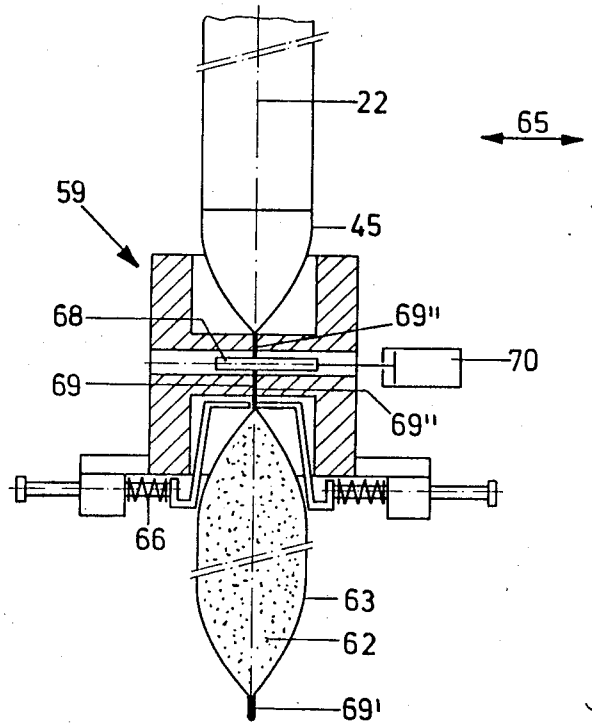
FIG. 6 shows the transverse welding means according to FIG. 5 in the closed position.
Figure 5:
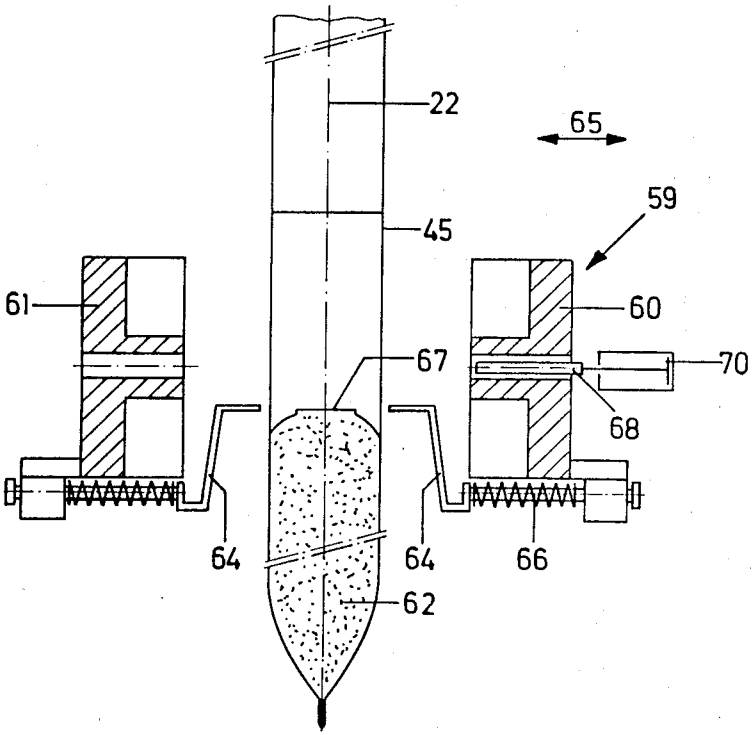
FIG. 5 shows the transverse welding means of the apparatus shown in FIG. 1 in a view corresponding to arrow V of FIG. 1 in an open position.

Each welding jaw is provided with a gripping member 64 which, in the displacement direction 65 of each welding jaw, is displaceably mounted thereon. Counter to the closing direction of the particular welding jaw, it is guided against a compression spring 66, so that on closing the welding jaws 60, 61, the two gripping members 64, which then jointly act as a gripping device, initially compress the foil tube 45 directly above level 67 of filling 62, so that it surrounds the filling 62 without leaving spaces, as can be gathered from FIG. 6. The foil tube 45 is then welded directly above the gripping member 64. In the final phase of bringing together the welding jaws 60, 61, gripping members 64 are displaced relative to the particular welding jaw 60 or 61. A cutting knife 68 is displaceably mounted in one welding jaw 60 and at the end of the welding process, but prior to the opening of the welding jaws 60, 61, it centrally cuts through the transverse weld 69, so that a filled tubular bag 63 drops downwards, which is sealed at the bottom with a transverse weld 69' and at the top with transverse weld 69''. The upper part of the centrally cut transverse weld 69 in turn forms the lower transverse weld 69'' of the next tubular bag to be filled and sealed. The cutting knife 68 is operated by means of a pneumatic piston-cylinder drive 70.

The welding jaws 60, 61 are guided on guide rods 71 mounted on the machine frame 1. They are driven by piston-cylinder drives located in the machine frame and not shown in the drawings.

The operation will now be described. A foil web from which the foil tube 45 is to be formed is made from a thermoplastic, i.e. weldable material, or from an aluminium foil coated with a thermoplastic, i.e. weldable material. The substances filled are, for example, sealing compounds, i.e. highly viscous materials, which already contain their hardener and which harden under the influence of atmospheric humidity. Such sealing compounds, referred to in exemplified manner here are widely used in the form of so-called permanent elastic sealing compounds.

After filling the dosing cylinder 4 by means of the supply line 6 in the position of the cone plug 7 shown in FIG. 2, the latter is displaced by 180°. Pressure medium is then supplied to the drive 13 by means of a not shown solenoid valve, so that the material is now forced in dosed manner through the discharge line 10, supply connection 24 and annular space 32 between the filling tube 23 and tappet 27 through the nozzle 25 with the valve 26 open. The quantity pressed out in dosed manner by the dosing piston 5 is accurately determined by means of the rotary pick-up 20, which accurately determines the travel of dosing piston 5 and consequently the material quantity supplied. This accurately defined material quantity is identical with the filling 62, because the complete system is filled with material and because such materials are incompressible. The conveying of the foil tube 45 is detected by rotary pick-up 52, whose signals, which are a measure of the conveying path of the foil tube 45, are used for controlling the drive for the conveying mechanism. The signals from the rotary pick-up 20, which represent the actual value for the dosed feeding of material, simultaneously give the desired value for the conveying of the foil tube 45, whose actual value is in turn determined by the rotary pick-up 52. As there is necessarily a certain distance between the cutting wire 38, i.e. the lower end of filling device 21, and the welding jaws 60, 61, the foil tube is conveyed in time-displaced manner with respect to the filling process caused by the dosing piston 5. When the material quantity given as a desired value and determined by the rotary pick-up 20 has been ejected by means of the dosing piston 5, the drive 13 of dosing device 3 is stopped and simultaneously the cone plug 7 is again rotated into the filling position shown in FIG. 2. Through a corresponding operation of the servodrive 30, the valve 26 is simultaneously closed and the rotary tube 33 is made to rotate by the drive motor 37, so that the cutting wire 38 cuts through the material strand in drip-free manner on the outside of the valve 26.

The conveying mechanism 46 continues to run until the conveying path of the foil tube 45 exactly corresponds to the material quantity supplied by the dosing device 3, so that as a result of this time displacement of the material feed on the one hand and the foil tube movement on the other, the level 67 of filling 62 is exactly in the area in which the gripping members 64 pinch off the foil tube 45, so that a bubble-free filling is ensured of the tubular bag 63 produced in the aforementioned manner. As a result of the continuous supply of nitrogen as an inert gas, it is ensured that during the filling process no air comes into contact with the materials to be filled and that any small bubbles possibly present in the tubular bag will contain a dry neutral gas and not air. As a result of the above-described servo-control of dosing and foil tube conveying, it is possible to ensure on the one hand that filling takes place in a substantially bubble-free manner and that on the other hand no material enters the transverse weld 69.

The invention is not restricted to the above-described embodiment but variations and modifications may be made without departing from the spirit and scope of the invention as defined in the appended claims.

What is claimed is:

1. An apparatus for the dosed filling of highly viscous material, into tubular bags, said apparatus comprising:

a dosing device for said viscous material comprising a dosing cylinder, a drivable dosing piston mounted within said dosing cylinder, and a pick-up connected to said dosing piston to detect the exact position of said dosing piston, whereby the quantity of the dosed material is determined;

a material filling device, said filling device having a filling tube, a foil format tube and a rotary tube;

said filling tube having one end connected to the dosing device to receive said viscous material therefrom and a valve at the other end, said foil format tube being circumferentially arranged around said filling tube;

said rotary tube being arranged between said filling and the format tube, said rotary tube having at its lower end at least one cutting wire positioned at the other end of said filling tube; and said filling tube valve being approximately flush with said cutting wire when said valve is closed;

a conveying means mounted adjacent said format tube to convey a formed foil tube along said format tube;

A transverse welding means having a cutting device and positioned below said filling device.

2. An apparatus as claimed in claim 1, wherein said pick-up connected to said dosing device is a rotary pick-up directly coupled to said dosing device.

3. An apparatus as claimed in claim 1, wherein said pick-up for determining the length of the foil tube is a rotary pick-up directly driven by the foil tube.

4. An apparatus as claimed in claim 1, wherein said format tube and said rotary tube are spaced from each other to define a channel for supplying inert gas.

5. An apparatus as claimed in claim 1, wherein said conveying mechanism has two diametrically opposite synchronously drivable, endless conveyor belts which are adapted to engage with the foil tube.

6. An apparatus as claimed in claim 1, wherein said transverse welding means has closable welding jaws, gripping members resiliently mounted on said welding jaws to pinch off the foil tube in advance of the closing movement.

* * * * *